United States Patent [19]

Kawasaki et al.

[11] 4,417,671

[45] Nov. 29, 1983

[54] AUTOMATIC VENDING MACHINE WITH ICE PREPARATION

[75] Inventors: Kikuo Kawasaki, Yokohama; Kazuo Yoshida, Hachiooji; Nobuo Nonoyama; Toshibumi Yamaguchi, both of Yokkaichi; Toshio Hasegawa, Suzuka; Jitsuo Okamura, Yokkaichi, all of Japan

[73] Assignee: Fuji Electric Co., Ltd., Kawasaki, Japan

[21] Appl. No.: 311,759

[22] Filed: Oct. 15, 1981

[51] Int. Cl.[3] ..... B67D 5/14

[52] U.S. Cl. ..... 222/56; 222/63; 222/65; 222/146 C; 62/137; 340/624

[58] Field of Search ..... 222/14–16, 222/23, 52, 56, 63–66, 129.1–129.4, 146 C; 221/92, 93, 96, 2, 5, 9, 13, 14, 206, 207; 62/137, 344; 340/612, 617, 623, 624

[56] References Cited

U.S. PATENT DOCUMENTS

| | | | |
|---|---|---|---|
| 2,996,222 | 8/1961 | Botkin | 222/67 |
| 3,211,338 | 10/1965 | Weil et al. | 222/129.1 X |
| 3,406,871 | 10/1968 | Hoenisch | 222/129.3 X |
| 3,721,369 | 3/1973 | Conti et al. | 222/67 |
| 3,931,911 | 1/1976 | Kohl | 222/56 |
| 3,992,941 | 11/1976 | McGoldrick | 340/623 X |
| 4,319,698 | 3/1982 | Tomiyama et al. | 222/146 C X |

*Primary Examiner*—Charles A. Marmor

*Attorney, Agent, or Firm*—Brumbaugh, Graves, Donohue & Raymond

[57] ABSTRACT

An automatic vending machine having a control circuit for controlling the quantity of ice in an ice storage chamber. A signal generating circuit is provided for producing digital signals in response to ice being supplied to, and discharged from, the ice storage chamber. A counting circuit comprising an up-down counter receives the digital signals and adjusts a count value which represents the quantity of ice in the storage chamber. The counter produces an output signal when sufficient ice is available to supply vending needs, but not when the ice quantity falls below a predetermined value. The vending operation is suspended when the counter output signal is not produced.

3 Claims, 12 Drawing Figures

S1
S2
S41a
S13
QCH
WRF
S3
S42
S5
REG
S8
S10
(A)
Full storage level
Short storage level
Full count
minimum value
P2

FIG. 6a
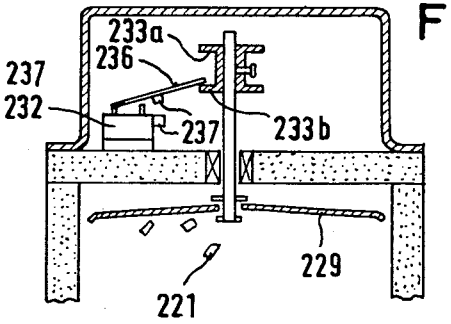
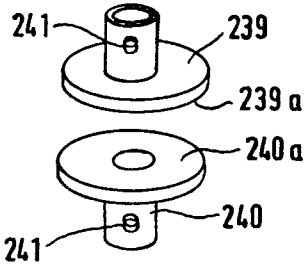
FIG. 6b
FIG. 6
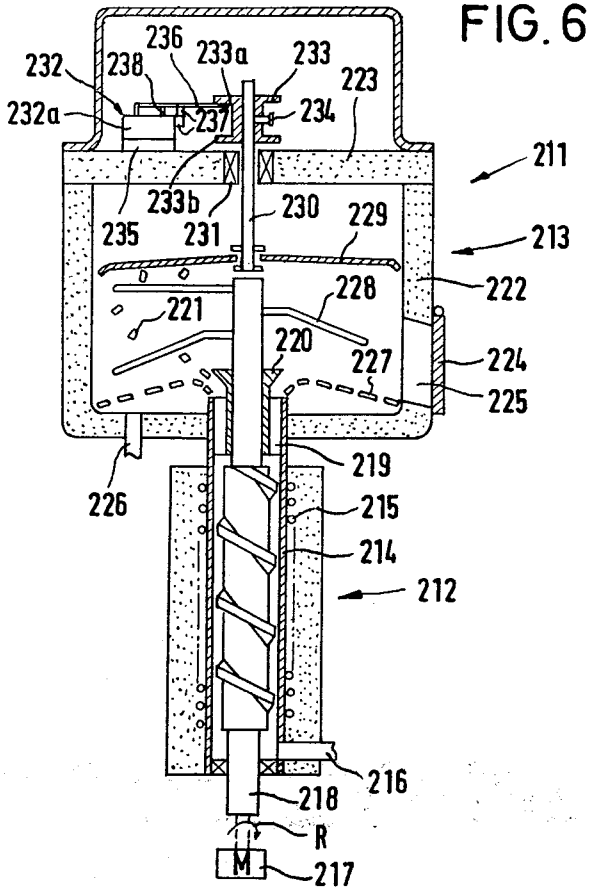

AUTOMATIC VENDING MACHINE WITH ICE PREPARATION

BACKGROUND OF THE INVENTION

TECHNICAL FIELD

The invention relates to an automatic vending machine for serving beverages with ice, and specifically to means for maintaining and supplying ice in an ice storage chamber.

DESCRIPTION OF THE PRIOR ART

A typical iced beverage vendor has an ice machine with an ice storage chamber. Whenever a vend signal is received, a certain quantity of ice is supplied from the storage chamber into a cup to serve a beverage, while other materials such as cold water, soda water, syrup, coffee, milk and/or sugar are supplied from storage boxes through mixing means to the cup. The ice storage chamber has a capacity for serving for a certain number of cups of beverage (i.e. for a number of times of vending service). However, the ice machine requires a relatively long time to produce the ice quantity for the full volume of the storage chamber as compared with the time required for the vending machine to serve one cup of beverage with ice.

A conventional beverage vendor has a limit switch for its ice storage chamber, so that when the storage chamber is entirely empty, the vending service is stopped or suspended and the ice machine starts its operation, which continues until the storage chamber is filled with ice. Then the vending machine service returns to normal operation. In such a vendor, however, if a number of times of successive vending services occur in a short duration, it often happens that a purchaser must wait a fairly long time, since the vending service is suspended during the time that the ice machine is producing ice. Of course, this results in inconvenience to a beverage purchaser.

SUMMARY OF THE INVENTION

The invention provides a vendor wherein the vending service can be resumed when a sufficient ice quantity has been produced for serving at least a cup of beverage, for example.

In order to attain this object, the invention comprises means for producing digital ice-production signals representative of quantities of makeup ice which the ice machine supplies to an ice storage chamber, and for producing digital ice-release signals representative of quantities of ice discharged from the storage chamber. An up-down counter is also provided which is connected to receive the ice-production signals at its count-up terminal and to receive the ice-release signals at its count-down input terminal. A count value stored in the counter is incremented in response to each pulse signal reaching the count-up input terminal, and is decremented in response to each pulse signal reaching the count-down input terminal. The counter produces an on-state output as long as the count value is not less than a predetermined minimum value (e.g. one). Control means are provided for rendering the vending service available in response to the counter having its output in the on-state.

The ice-production signals may be pulse signals produced whenever the ice machine feeds makeup ice of a predetermined unit quantity (e.g. a quantity for a cup of beverage) to the ice storage chamber. This can be accomplished by detecting each interval of time of ice machine operation which results in production of that predetermined unit quantity of ice.

The ice-release signals may be produced in conjunction with operation of an outlet gate of the ice storage chamber, or may be derived from vend signals. (The vend signal is a signal produced in response to customer's demand for vending service. The vend signal is directly or indirectly supplied to the ice storage chamber outlet gate actuator to deliver ice for beverage service).

In one embodiment of the invention, each of the ice-release signals may be produced directly in response to each vend signal, or in response to each opening operation of the ice storage chamber outlet gate. In another embodiment, each of the ice-release signals is produced whenever the ice storage chamber outlet delivers a predetermined unit quantity of makeup ice; and a plurality of unit quantities of ice represents the ice quantity for a cup of beverage.

Usually, in a modern automatic vending machine, a one-chip microcomputer is used to control its operation, and a random access memory (RAM) comprises part of the microcomputer. A region of the RAM can serve as the counter used to register a number indicative of the ice storage quantity. The control and operation can take place as follows.

Initially the ice machine is in operation and supplies ice to the storage chamber. When the ice storage quantity in the storage chamber reaches a predetermined upper level, an ice level sensor provided therein is turned on, and produces sensor signal, and the ice machine is turned off. A presetting means associated with the counter is responsive to the sensor signal, and sets the counter to a value indicating a predetermined full count. In this situation, since the counter has a count not less than the predetermined minimum value (e.g. a value of one, in one embodiment), the counter will continue to produce an on-state output signal, in response to which the control means renders the vending machine ready for vending service.

After one or more cups of beverage with ice have been vended, a certain reduction of ice in the ice storage chamber turns the ice level sensor off, and the ice machine starts.

The counter operates in response to changes of ice storage quantity, as follows. When a cup of beverage with ice is vended, the counter is decremented by a certain number $n_1$. (In a first embodiment of the invention, where the ice-release signal is the vending signal itself, the number $n_1$ is one, i.e. the counter counts "$-1$".)

With each pulse of the ice-production signals resulting from the ice machine operation, the counter is incremented by $+1$. (In the first embodiment, a count of one in the up-down counter corresponds to a quantity of ice for one cup of beverage, while in another embodiment, it corresponds to only a portion of that quantity.)

If successive vending operations occur in a relatively short time duration (so that the ice storage supply decreases far more quickly than replacement thereof by the ice machine), the counter decreases its stored count. When the count becomes lower than the predetermined minimum value, the counter turns its output off. In response to the counter output turning off, the control means stops the vending service. An indication means then shows a sold-out condition to customers.

After such stopping of the vending service, the first ice-production signal to be generated which causes the count to be equal to or greater than the minimum value will cause the counter output to be turned on. At that time, the vending service is reactivated, and the sold-out indication is terminated. Thus, even though the level of ice is low, if a purchaser desires a beverage with ice, it will be supplied, in contrast with the prior art devices where the vending service is suspended until the ice storage is totally refilled.

In a modified embodiment of the invention, the ice-release signal producing means can generate pulse trains each consisting of a number of pulse signals. The number of pulses is proportional to the duration that the outlet gate of the ice storage chamber is open. Such signal producing means can comprise an AND-gate and an oscillator, described more specifically later, which supplies the up-down counter with dynamic information representing the quantity of ice per cup of beverage, which quantity can vary. This is especially useful for a recent type of automatic vending machine which serves several types of beverages, or different sizes of cups, for instance.

Further advantages will become more apparent from following the detailed description taken in conjunction with the attached drawings.

BRIEF DESCRIPTION OF THE DRAWINGS

FIG. 6 is an elevational view, in cross-section, of an embodiment of a mechanical means for setting the levels to turn the ice storage sensor output on and off with hysteresis;

FIG. 6*a* is a view showing the mechanical means of FIG. 6 in a position different from that in FIG. 6;

FIG. 6*b* is a perspective view of an alterative embodiment of one of the parts in FIGS. 6 and 6*a*.

DETAILED DESCRIPTION OF THE PREFERRED EMBODIMENTS

Figure 1:
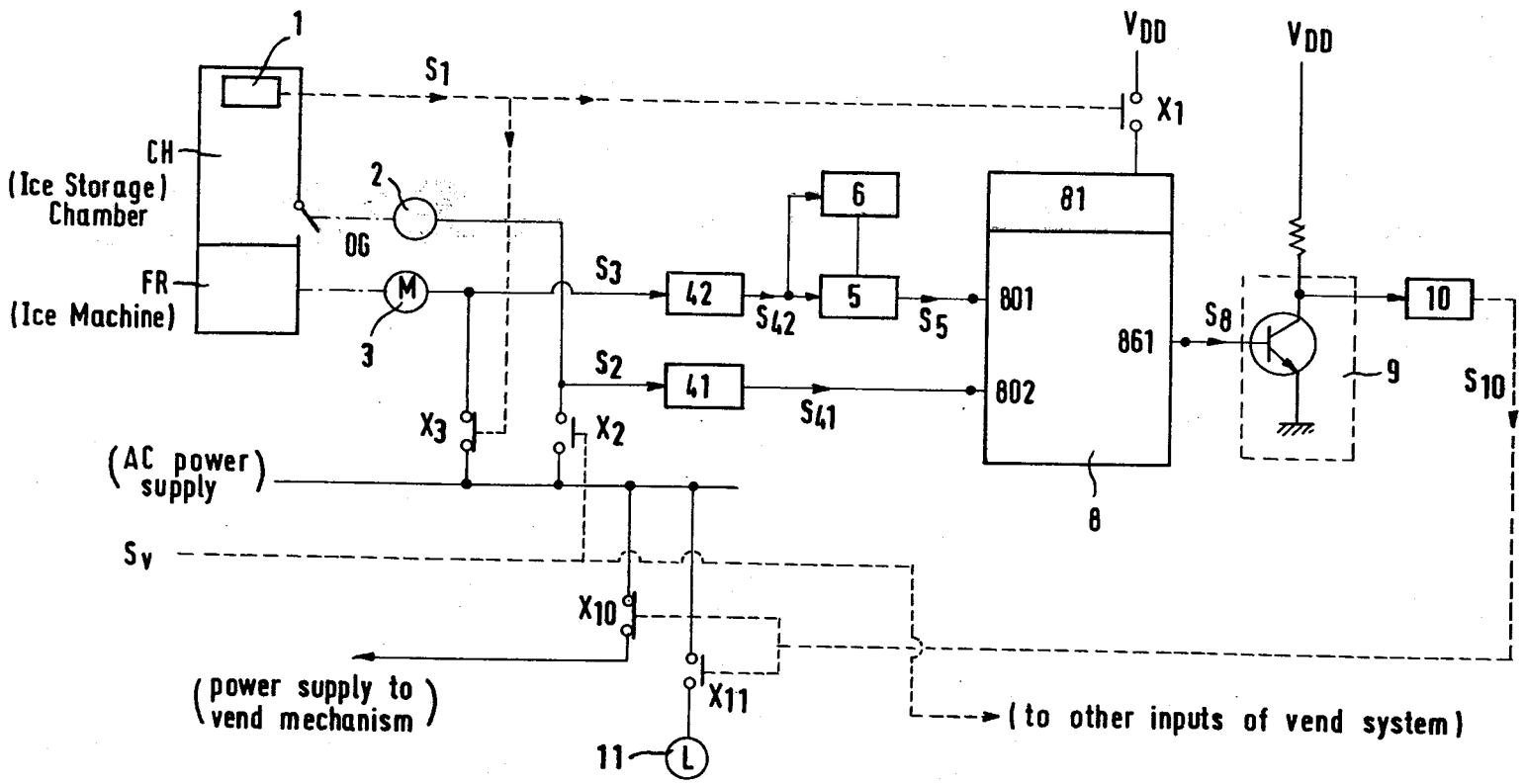
FIG. 1 is an electrical schematic diagram of a first embodiment of the vending service control device with ice storage counting according to the invention.

FIG. 1 is a schematic block diagram showing a first embodiment of the vending service control system according to the invention. Miscellaneous non-essential parts are omitted. Reference numeral 1 denotes an ice storage sensor which is mounted in an ice storage chamber CH, and produces an output signal $S_1$ as long as a predetermined full ice quantity exists in the chamber. When the quantity in ice storage becomes less than a predetermined short (i.e. below maximum) storage level, output signal $S_1$ is no longer produced. (The difference between the full quantity level and the short storage level may be nearly nil as in conventional cases, or may be a significant value as mentioned below.)

Reference numeral 2 denotes an actuator for an ice outlet gate OG for the ice storage chamber. When a vending signal $S_v$ is produced by a customer, requiring ice to be supplied, a switch $X_2$ is closed, to energize the actuator 2 so that the gate OG is opened. The actuator 2 may include an electromagnetic solenoid.

Reference numeral 3 denotes a motor for a compressor of an ice machine FR. Whenever the ice storage sensor 1 detects the ice storage quantity being less than the predetermined short storage level, i.e. whenever the sensor output signal $S_1$ is no longer produced, a switch $X_3$ is closed, to start the motor. When the sensor 1 detects the ice storage quantity being at the predetermined upper lever showing the full ice storage, the sensor 1 produces the signal $S_1$ to trip the switch $X_3$, to stop the motor 3 of the ice machine. In this regard, the operation is substantially similar to other known techniques.

However, the system of the invention includes a conventional up-down counter 8, which can be in the form of a random access memory (RAM) in a one-chip microcomputer. The counter 8 is provided with a presetting circuit 81 responsive to an input signal to set the counter 8 to a predetermined full count corresponding to the number of cups of beverage service with ice which the full ice storage can supply. Such a presetting circuit can be formed by plural switch elements respectively associated with flip-flops of the up-down counter. (A typical up-down counter can be composed of cascaded flip-flops with gate circuits inserted among them, as is well known.) The full count to be preset can be adjusted in advance.

The input signal to the presetting circuit 81 is fed from an auxiliary DC voltage supply $V_{DD}$ when a switch $X_1$ is closed. The switch $X_1$ is closed by the sensor output signal $S_1$, indicating the predetermined full ice quantity in storage. When the counter 8 has a full count (more specifically, a count not less than the predetermined minimum value), it produces an output $S_8$. A NOT-circuit 9, which may be a transistor, is connected to the output of the counter 8. In response to the output signal $S_8$, the NOT-circuit 9 releases a "sold-out" relay 10 so as to open a contact $X_{11}$ associated with the relay 10. When contact $X_{11}$ opens, a sold-out signal lamp 11 is extinguished, indicating that the vending machine is ready for service. Also, when the "sold-out" relay 10 is released, contact $X_{10}$ is closed, to supply power to a vending mechanism.

Reference characters 41 and 42 respectively denote first and second AC/DC signal converters which each transform an AC input signal into a DC output signal. Specifically, the second converter 42 produces a DC output signal identical in duration to the AC input signal. Each of the signal converters 41 and 42 may consist of a current transformer, a rectifier, capacitors and resistors, or alternatively may consist of a relay and a contact connected with an auxiliary DC voltage supply.

The first converter 41 is connected to detect the energization of (or voltage across) the solenoid of the ice outlet gate actuator 2. Whenever a vend signal $S_v$ is produced, indicating that a supply of ice is needed, switch $X_2$ for the ice outlet gate actuator 2 is closed, and an input signal $S_2$ is supplied to the converter 41, which in response thereto produces an output signal $S_{41}$, which is a pulse. The output of the converter 41 is connected to a count-down input terminal 802 of the up-down counter 8, which in response to signal $S_{41}$ changes the count by minus one ("−1"), i.e. decrements or decreases the count by one. In this embodiment, a count of "one" is representative of the quantity of ice for one cup. Thus, a decrement of "one" means that the ice in the ice storage chamber is decreased by the quantity used for one cup of beverage service.

The other signal converter 42 is connected to detect power being supplied to the ice machine motor 3 (for example, a current transformer may be inserted into the power supply line to the motor, or a voltage relay may be connected across the motor terminals). During the time that the motor 3 is running, an AC input is supplied to the converter 42, and a DC output signal $S_{42}$ is produced, which is supplied to a pulse generating circuit 5. This circuit 5 is also driven by a timing means 6, to the input of which is supplied the signal $S_{42}$. Circuit 5 produces an output signal $S_5$ comprising output pulses at predetermined regular intervals after the start of the output signal $S_{42}$ of the converter 42. The pulses of output signal $S_5$ are produced as long as the signal $S_{42}$ is produced (i.e. during the time that the motor 3 is in operation). The timing means 6 sets the length of the regular time interval. Each pulse of output signal $S_5$ is supplied to a count-up input terminal 801 of the up-down counter 8, which in response thereto changes the count by plus one ("+1"), i.e. increases the count by one. In this embodiment this indicates that the quantity of ice in the ice storage chamber is increased by the quantity needed for one cup of beverage service. By adjusting the length of the time interval produced by the timing means 6, one can adjust the ice quantity represented by each of the repetitive pulses from the circuit 5. Specifically, the circuit 5 can be formed as a duration comparator means with a trigger, so that it compares the duration of its input signal from the converter 42 with the reference time interval set by the timing means 6, to produce an output pulse whenever the duration of $S_{42}$ is equal to an integral multiple of that reference time interval.

The count of the counter 8 goes up and down in response to respective input signals to the count-up and count-down input terminals. If the count becomes less than the predetermined minimum value (one, in this case) due to a number of successive occurrences of downward counting for example, then the counter ceases producing an output signal $S_8$, so that the NOT-circuit 9 trips the "sold-out" relay 10. Then the associated normally open contact $X_{11}$ is closed to light the sold-out signal lamp 11, while the normally closed contact $X_{10}$ is opened, to deactivate the vending service. (Alternatively, it is possible to use the signal lamp 11 only for a "no-ice" indication (instead of a totally inoperative "sold-out" indication) and to omit the other contact $X_{10}$, provided that non-iced beverage service is also to be available.) Operation of the machine in such an arrangement will be described in conjunction with FIG. 3.

If only a relatively few vending services occur so that the ice machine produces a sufficient quantity of replacement ice to maintain the full storage capacity, then the resulting output signal $S_1$ of the ice storage sensor 1 sets the counter to the predetermined full count as aforementioned.

The up-down counter 8 is preferably digital. The count capacity should be related to the number of vending services from a full storage of ice. The capacity of the up-down counter 8 in the above embodiment having x bits in binary code will suffice for a machine having ice storage for y cups of beverage (i.e. y times of vending service), if $y \leqq 2^x - 1$ (here, "−1" is included because the count of zero is below the above minimum value and signifies that the ice storage chamber is empty).

The setting of the two ice levels at which the ice storage sensor is turned on and off respectively should preferably not be equal, but instead should be sufficiently different (a kind of hysteresis separation) in order to minimize frequent repetitions of starting and stopping the ice machine. This will increase the lifetime of the machine. Such a level setting with hysteresis may be obtained by mechanical or electrical means (see a later description).

Figure 1A:
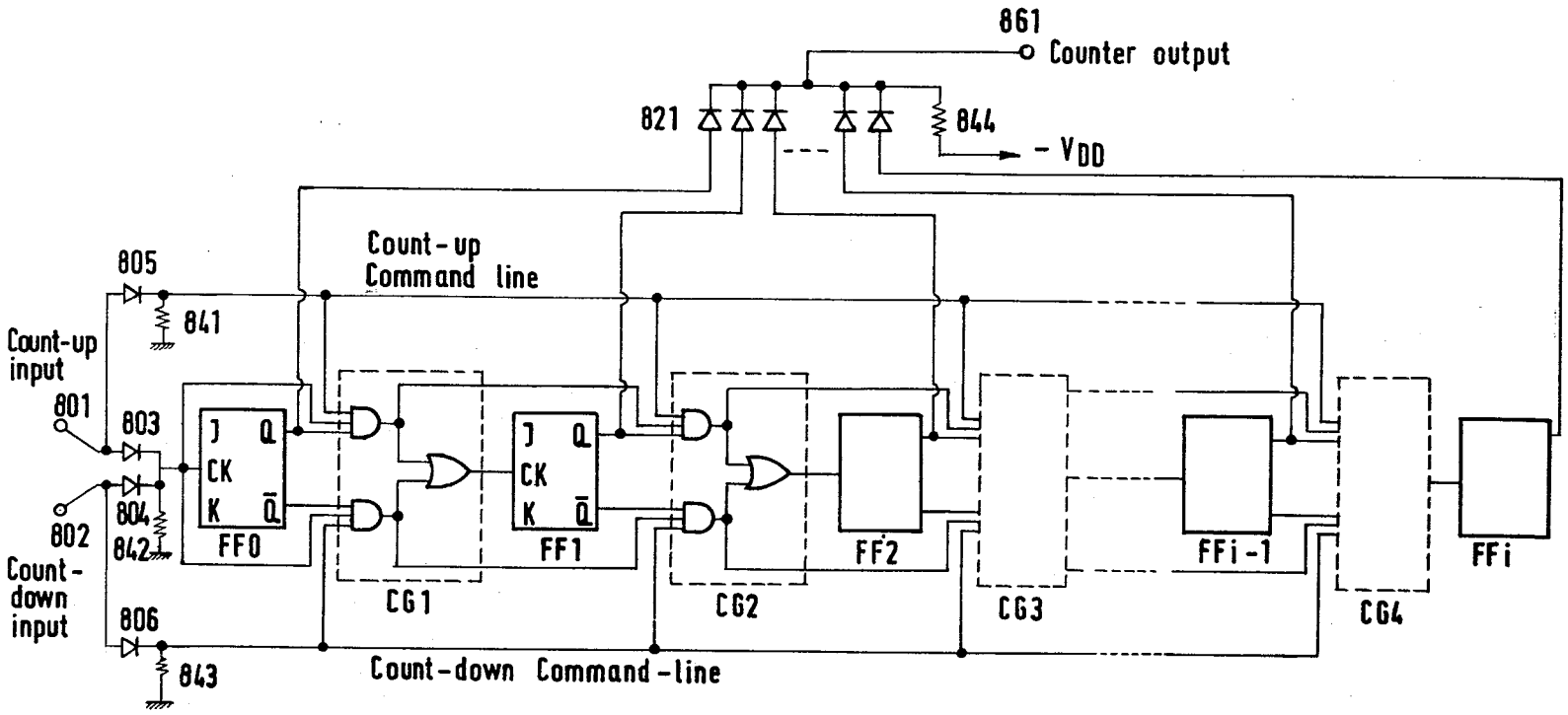
FIG. 1*a* is a schematic diagram of an up-down counter to be used in the invention.
Figure 1B:
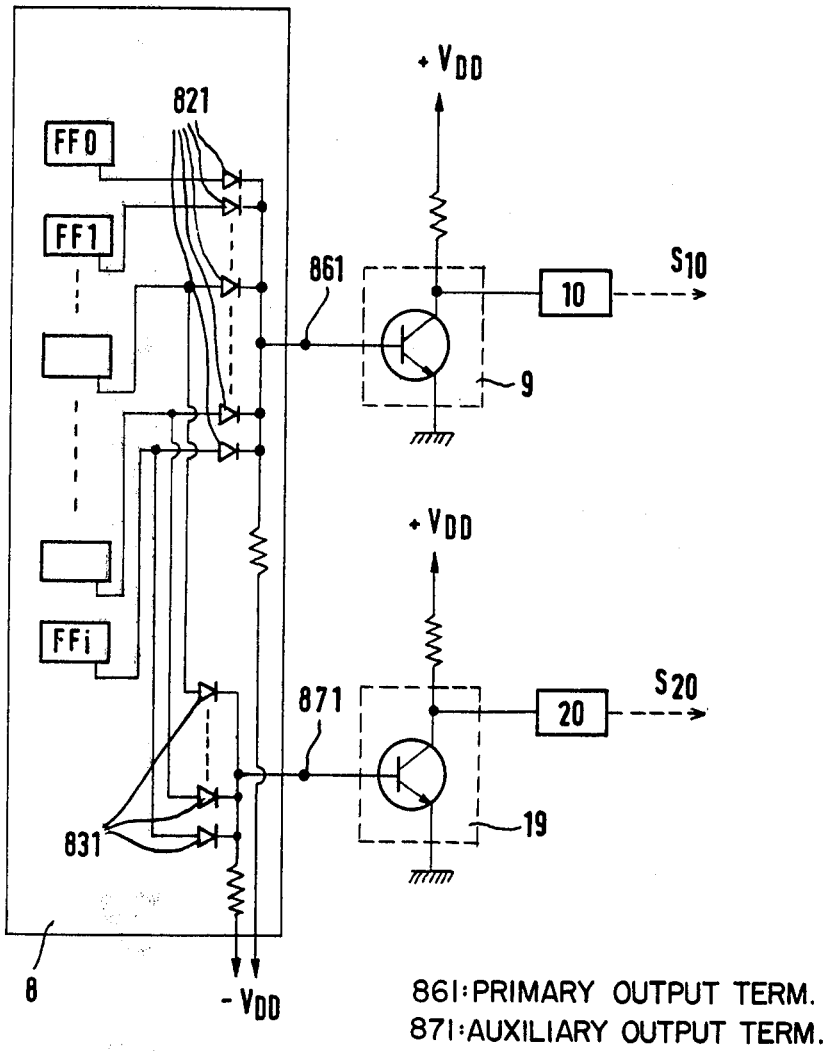
FIG. 1*b* is a schematic diagram of a modification in the output circuit of the up-down counter of FIG. 1*a*, provided with an auxiliary output terminal to produce a signal for initiating the ice machine operation.

Alternatively, the up-down counter 8 can include means to produce an auxiliary output starting the ice machine when the count of the counter decreases to a value less than a predetermined intermediate value below its full count. In an up-down counter formed of cascaded flip-flops ($FF_0$, $FF_1$, $FF_2$ . . . $FF_i$) provided with diodes (821 in FIG. 1*a*) connected respectively to the Q-outputs of the flip-flops, the above auxiliary output means can be comprised of additional diodes 831 (FIG. 1*b*) connected to the Q-outputs of the flip-flops which are at the positions corresponding to values less than the predetermined intermediate value. This means will also comprise an additional NOT-circuit (transistor) 19, and an additional relay 20. As long as the count is not less than the intermediate value, the output at point 871 through the additional diodes 831 will be in the on-state, with the result that the output of the transistor 19 prevents operation of the relay 20. When the count becomes less than the intermediate value, the output at point 871, through the additional diodes 831, will be in the off-state, so that the transistor 19 energizes the relay 20 to initiate the ice machine operation. (Suspending operation of the ice machine is accomplished by the sensor output signal $S_1$ as mentioned above.)

Figure 2:
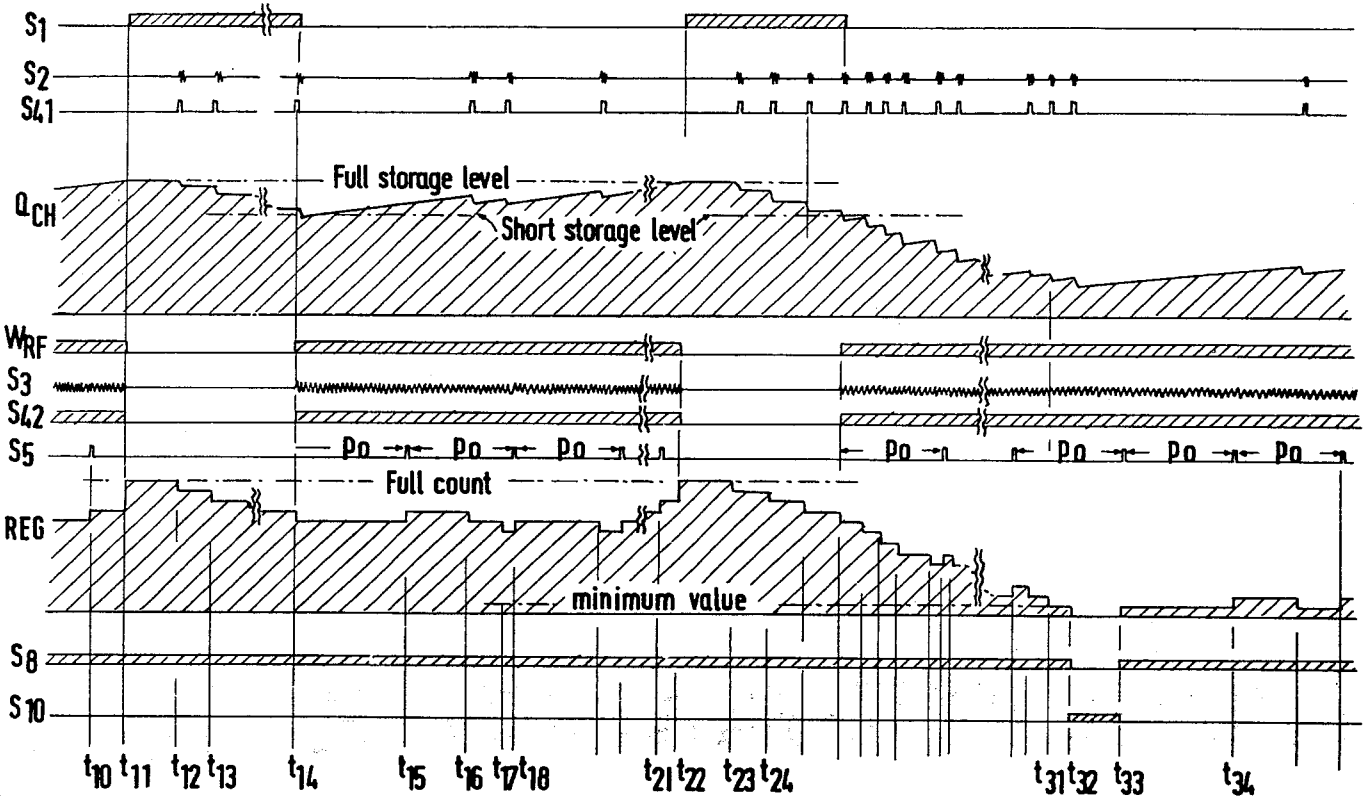
FIG. 2 is a typical operation chart showing signals and performances of the device of the first embodiment.

FIG. 2 is a chart of waveforms showing signals and operations of the device of the first embodiment, responsive to ice discharges and variations in ice storage.

FIG. 2 illustrates the ice storage level $Q_{CH}$ rising to its full level at a time $t_{11}$. At time $t_{11}$, the ice sensor signal $S_1$ switches to an on-state, and the ice machine motor operation $W_{RF}$ is stopped. At a time $t_{12}$ an ice discharge from the storage chamber takes place, an actuator operation signal $S_2$ occurs, so that the first signal converter 41 produces a DC pulse signal $S_{41}$, in response to which the counter registration or count REG decreases by one. Similar occurrences take place for example at times $t_{13}$ and $t_{14}$.

When the ice storage quantity drops to the predetermined short storage level at the time $t_{14}$ (or the registration REG becomes less than the intermediate value, not shown, at $t_{14}$), the ice machine motor $W_{RF}$ starts its operation (due to the ice sensor output turning off or due to the auxiliary output of the up-down counter, as previously mentioned). When the ice machine motor starts, an ice machine motor operation signal $S_3$ is produced and is sustained during the running of the ice machine, so that the second signal converter 42 produces a DC signal $S_{42}$ for the same duration. At a time $t_{15}$, (a predetermined time interval $P_o$ after the time $t_{14}$), a pulse of signal $S_5$ is produced by the pulse generating circuit 5 fed by the DC signal $S_{42}$. In response to the pulse of signal $S_5$, the counter registration REG increases by one. Subsequently, successive pulses of signal $S_5$ are produced at the same interval $P_o$, as long as that signal $S_{42}$ is produced, during which, when an ice discharge occurs, for example at a time $t_{16}$, it produces responses similar to those at the time $t_{12}$. Thus the counter registration goes up and down with the variation in the actual ice storage.

When the ice quantity $Q_{CH}$ reaches the full storage level (at a time $t_{22}$), the ice storage sensor detects this and turns its signal $S_1$ on, so that the ice machine is stopped, whereupon the signals $S_3$ and $S_{42}$ are no longer produced. On the other hand, when the downward countings exceed the upward countings in the counter, and the counter registration drops to zero (for example at a time $t_{32}$), then the counter output $S_8$ is turned off and the "sold-out" signal (or "no-ice" signal) $S_{10}$ is produced. At an interval not longer than $P_o$ after the time $t_{32}$, a first pulse of signal $S_5$ of the pulse generating circuit 5 is produced. Consequently the counter registration increases by one, the counter turns its output $S_8$ on, and the "soldout" signal $S_{10}$ ceases.

Figure 3:
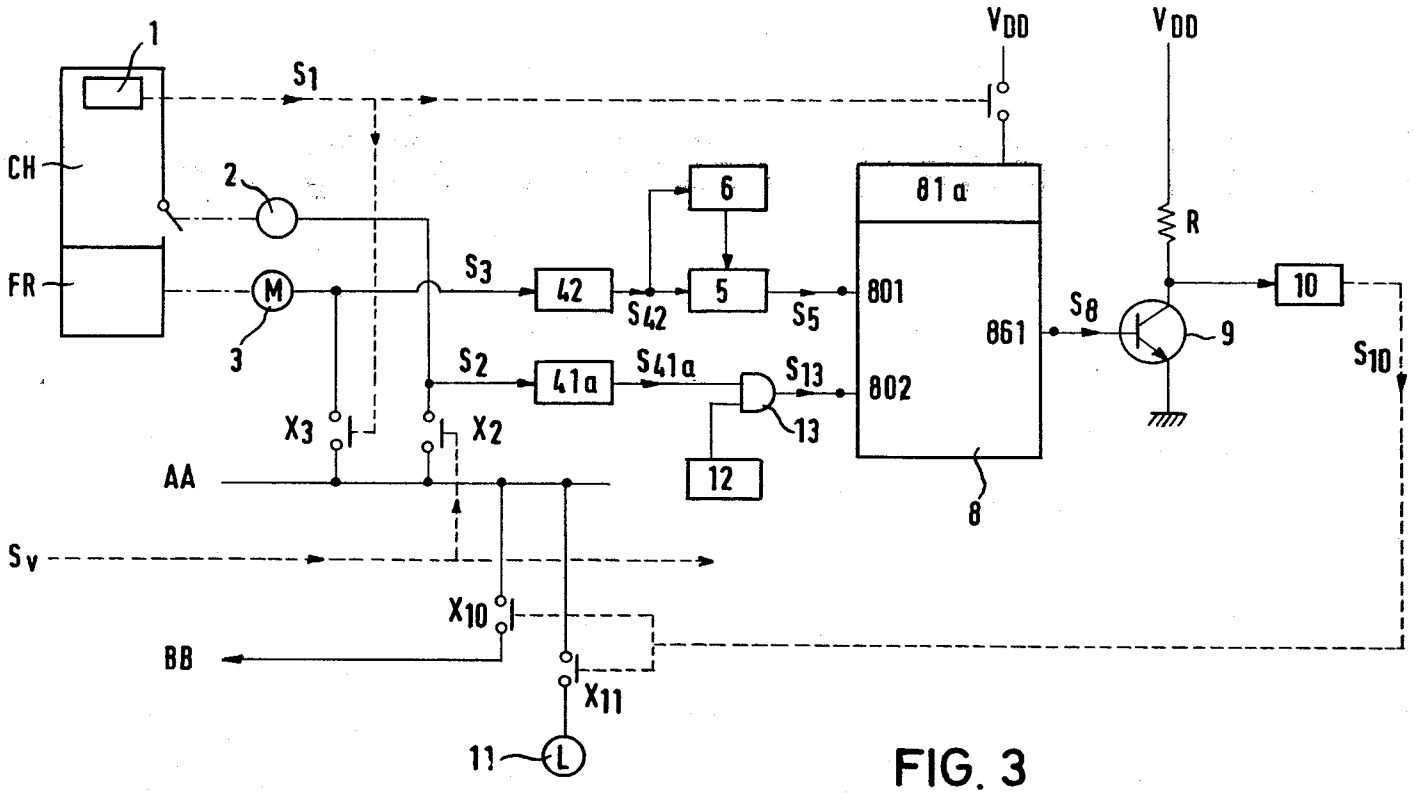
FIG. 3 is a schematic diagram of a second embodiment of the invention.

FIG. 3 shows a second embodiment of the device of the invention. It includes like parts as used in FIG. 1, which are denoted by like reference numerals and characters. However, this second embodiment has an additional pulse generator 12 connected to one input of an AND-gate 13, the output of which is connected to the count-down input terminal 802 of the up-down counter 8. Also, an AC/DC signal converter 41*a* is connected to the other input of the AND-gate 13, and detects the energization of terminal voltage of the outlet gate actuator 2. Signal converter 41*a* produces a DC output signal $S_{41a}$ identical in duration with the AC input signal. Signal converter 41*a* is similar to signal converter 42.

The second embodiment of the invention is particularly directed to the vending machine service having a variable quantity of ice supply per cup of beverage. A unit count in the counter represents a fraction of the ice quantity needed for one cup of beverage. An ice quantity for a cup of service is perceived as a mass comprising a plurality of unit amounts each of which is of a fragmental unit quantity of ice. A variable ice quantity for a cup of service, then, can be represented by the number of the unit amounts (or fragmental unit quantities) comprised therein. Therefore, if the pulse signals to the count-up and count-down input terminals of the up-down counter 8 are (as described later in detail) produced whenever a fragmental unit quantity of ice is produced for makeup to the storage chamber, or discharged for service from the storage chamber, then the registration of the counter 8 can represent the ice quantity in the storage chamber more accurately than in the first embodiment.

In the second embodiment, the quantity of ice supplied from the ice storage chamber is generally proportional to the duration during which the ice outlet gate of the storage chamber is open. The pulse signals to the counter inputs are obtained in relation to durations of operations of the ice outlet gate as well as of the ice machine. In other words, the counter 8 serves to register a representation of the ice storage quantity translated into an available remaining duration of ice supply operation. The up-down counter 8 registers digitally the duration of time that the ice outlet gate can remain open before the ice quantity remaining in the storage chamber will be depleted.

A presetting circuit 81*a* is provided, which is substantially similar to the circuit 81 in the first embodiment and which sets the counter 8 to a predetermined full count in response to its input signal. A full count corresponds to the duration in which a full ice storage is emptied by having the ice outlet gate continuously open.

Therefore, the substantial difference between the counters of the first and second embodiments is in their capacities. The counter of the second embodiment requires a larger count capability (i.e. more bits in binary code) than the counter in the first embodiment, because the former can represent more variations of ice quantity in the ice storage chamber. For example, in the case where the duration to empty the full ice storage is 30 seconds, and an average duration to serve ice for one cup of beverage is 2 seconds, the full registration of the counter in the first embodiment should be at least $30/2=15$, which requires only 4 bits in binary code. In the second embodiment, if the fragmental unit quantity is chosen as a quantity to be discharged through the ice outlet gate in a duration of 0.1 second, the full registration should be at least $30/0.1=300$, which requires 9 bits in binary code. Thus, while the second embodiment is more versatile, a larger capacity counter is required.

In the second embodiment, the counter 8, when having a full count (or any count not less than a predetermined minimum value which is, for example, a count corresponding to an expected maximum quantity of ice required for one cup of beverage), produces the output mentioned in the first embodiment, so that the NOT-circuit 9 releases the "sold-out" relay 10, so that contact $X_{11}$ is opened, the "sold-out" signal lamp 11 is extinguished and contacts $X_{10}$ are closed, rendering the machine ready for vending service.

When a vend signal $S_v$ is produced, which results in ice dispensing by opening the ice outlet gate for a duration of $d_1$ seconds, (i.e. by energizing the solenoid 2 for the duration of $d_1$ seconds), then the converter 41*a* receives an input signal $S_2$ for the duration of $d_1$ seconds, and produces an output signal $S_{41a}$ for that duration. For that duration the AND-gate 13, which receives the output signal $S_{41a}$ of converter 41*a*, passes inputs supplied to it from the additional pulse generator 12. This pulse generator 12 is a type of oscillator which produces pulses at predetermined regular intervals of $p_1$ seconds. The number of the pulses passing through the AND-gate 13 for that duration $d_1$ is proportional to the length of that duration. These pulses reach the count-down input terminal 802 of the up-down counter 8. In response thereto, the counter 8 counts downward by a number equal to the number of pulses, (i.e. decreases the registration by a value proportional to the length of that duration $d_1$), which number is representative of the quantity of ice delivered through the outlet gate from the ice storage chamber.

While the ice machine motor 3 is running to produce ice, a continuous input is supplied through the signal converter 42 to the pulse generating circuit 5, which is also fed by the timing means 6, as in the first embodiment. The circuit 5 produces output pulses ($S_5$) at predetermined regular intervals of $p_2$ seconds, as long as it receives an input signal, i.e. when the motor 3 is running. In this context, one primary difference between the two embodiments is in the length of the pulse interval defined by the timing means 6. The second embodiment has the pulse interval $p_2$ far shorter than the pulse interval $p_o$ in the first embodiment. Pulse interval $p_2$ is determined in reference to the pulse interval $p_1$ at which the additional pulse generator 12 produces pulses. More specifically, these intervals are determined so that $p_1/p_2=q_2/q_1$, where $p_1$ and $p_2$ are the respective pulse intervals for the pulse generator 12 and the circuit 5, and $q_1$ and $q_2$ are respective ice quantities (per second) passing through the outlet gate of the ice storage chamber and produced by the ice machine. When the ice machine is in operation, the count-up input terminal of the counter 8 receives those output pulses of the circuit 5, so that the counter 8 counts upwards by the number of pulses, (i.e. increases the registration by a value proportional to the ice machine operation duration and which is representative of the ice quantity produced by it.)

Thus the registration of the counter 8 goes up and down in proportion to the variation of the ice storage in the ice storage chamber. If the registration decreases to a value less than its predetermined minimum value, [for example a number $n_{u.max}$ of count which corresponds to an expected maximum quantity $q_{u.max}$ of ice required for one cup of beverage, or which is given by $n_{u.max}=q_{u.max}/(q_1\ p_1)=q_{u.max}/(q_2p_2)$], the "sold-out" signal lamp 11 is lit and the vending service is suspended, as in the first embodiment.

By adjusting the length of the pulse interval of the timing means 6 in the second embodiment, the device can accommodate variations between the ice production quantity per second by the ice machine and the ice delivery quantity per second through the ice outlet gate.

The second embodiment can be adapted to meet the following additional requirements if desired. In case a vendor requires a variety of services such as plural kinds of beverages or of cup sizes, a variety of quantities of ice supply per beverage cup can be provided. In some cases, it is desirable for a customer to have the option of selecting one quantity from a variety of ice quantities for a beverage. This can also be provided. For a vendor manufacturer using a variety of capabilities of ice machines for various kinds of vendors, a variety of adaptability of a universal ice storage registration and control logic can be provided, as required.

Figures 4, 4A:
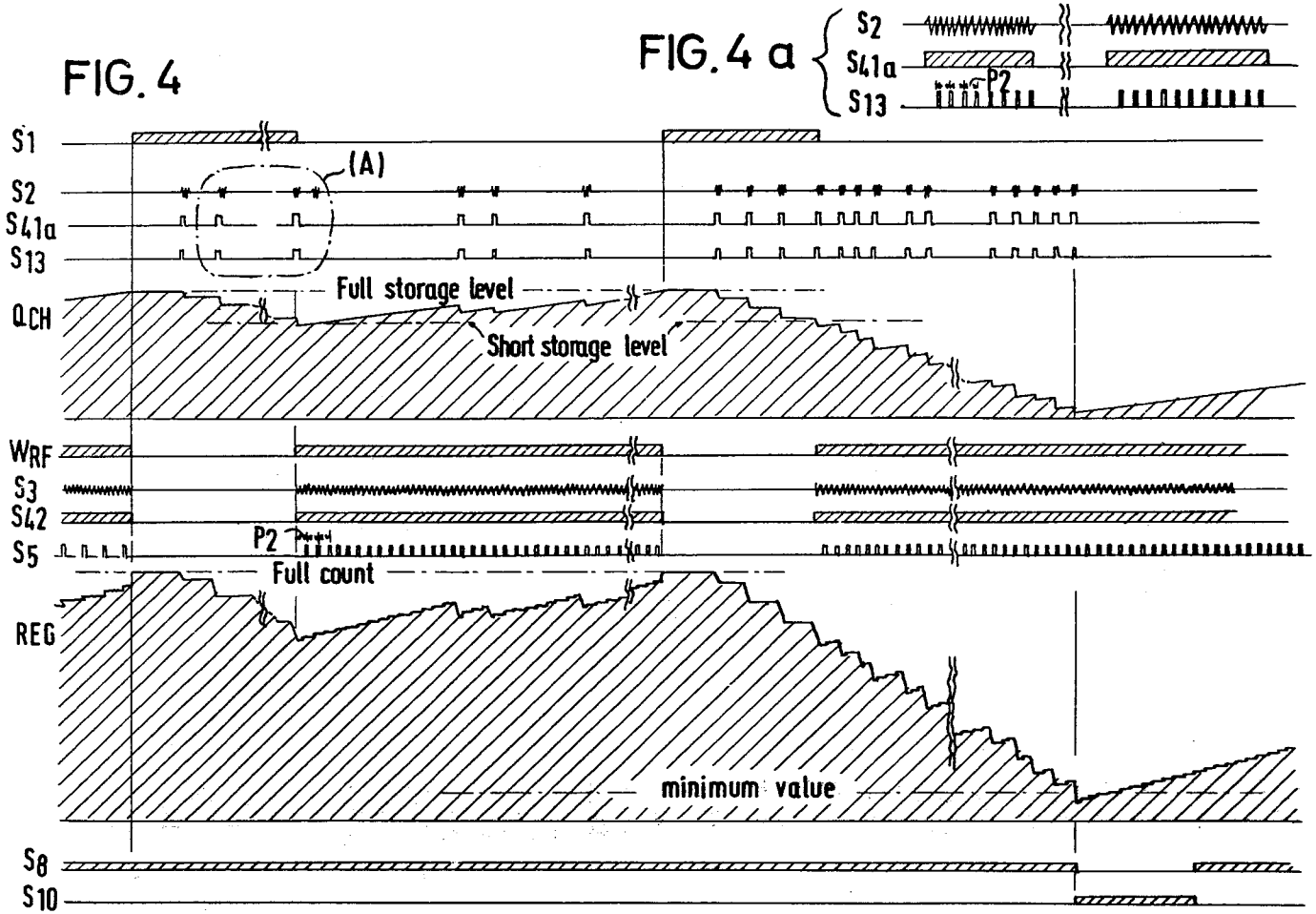
FIG. 4 is a typical operation chart of the embodiment of FIG. 3.
FIG. 4*a* is an expanded display of part of the chart of FIG. 4.

FIG. 4 is a chart of waveforms showing signals and operations of the device of the second embodiment, responsive to ice discharges and variations in ice storage. It is generally similar to FIG. 2. However, the differences therebetween will become apparent from the following.

The signal $S_{41a}$ produced by the first signal converter 41*a* has a duration proportional to that of the actuator operation signal $S_2$. Here another signal $S_{13}$ is produced (as the output of the AND-gate 13), which is a pulse train having its duration substantially equal to that of the signal $S_2$, and which consists of pulses occurring at regular intervals of $P_1$ seconds. Each of these pulses serves to decrease the counter registration by one, with each one count of the registration representing a smaller unit of ice quantity as compared to the quantity for one count of the registration in the first embodiment. Also, a decrease of the counter registration appearing in response to one output of ice outlet gate actuator signal $S_2$ (i.e. in response to one action of the actuator) is not always uniform, but instead varies in proportion to the duration of the output of signal $S_2$. Also, the pulse interval $P_2$ of the signal $S_5$ produced by the pulse generating circuit 5 is far smaller than that ($p_O$) in the first embodiment, through the attached drawings may not be adequately proportional in this context.

Thus, the signal which carries data of the ice discharge quantity at each vend operation is a pulse generated at each vend of a cup of beverage in the first embodiment, whereas in the second embodiment, it is a pulse train which comprises pulses generated at regular intervals and which has a duration proportional to the duration of opening of the ice storage chamber outlet gate.

Further, one can have also an alternative intermediate the first and second embodiments. This can be applicable for the cases where only a few varieties of ice quantity per cup of beverage service are required instead of many. There, some predetermined durations of the ice outlet gate actuator operation can be specified corresponding to those varieties. And correspondingly, the same plurality of signals can be specified to carry information representing what quantity of ice is discharged from the ice storage chamber at each vend operation. Then, if the varieties of ice discharge quantities and the corresponding signals are stored in advance in some memory region of the one-chip microcomputer, the specified variety in number of downward counting can take place in the up-down counter. For this alternative, the particular drawing is not attached, since such a configuration may be designed without it.

Figure 5:
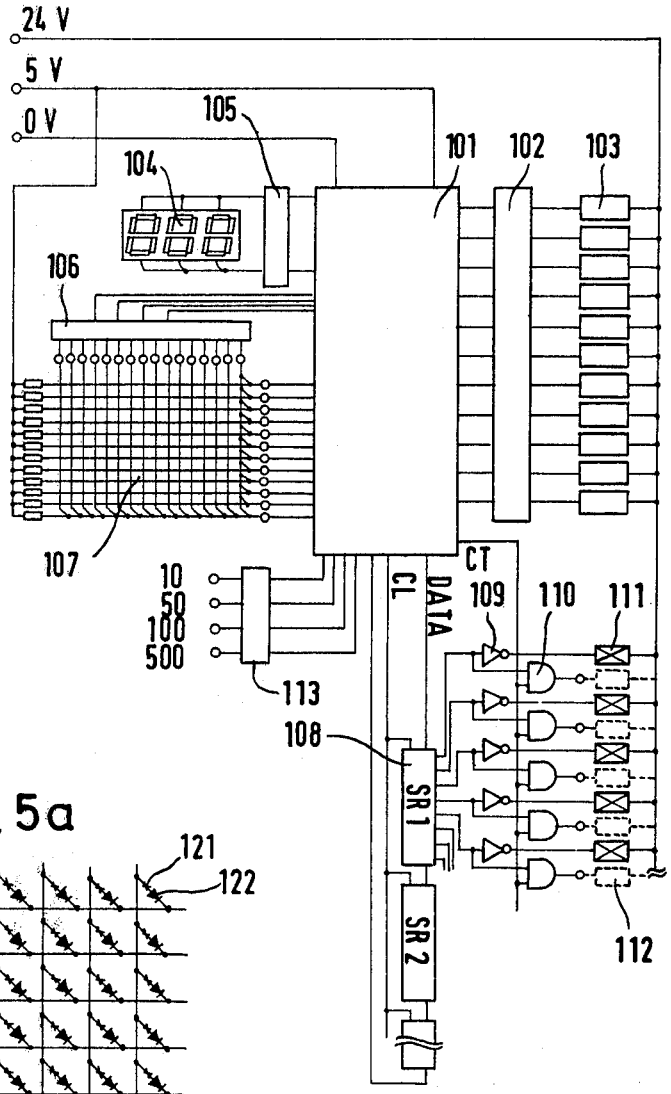
FIG. 5 is a block diagram showing an electronic control system for a vending machine including circuitry according to the invention.

FIG. 5 is a block diagram of an electronic control system in an automatic beverage vending machine, provided with a one-chip microcomputer 101 and other members. Necessary elements such as a read only memory, random access memory, input-output ports and clock pulse generator are all provided in the one-chip entity 101. The system is also provided with an input connection circuit 107 which serves to feed the microcomputer with various types of input information such as selection of commodities, setting of prices for commodities, setting of quantities of materials to serve, setting of timings to discharge or to process materials and of other various timings, and those from sensors of material quantities.

Figure 5A:
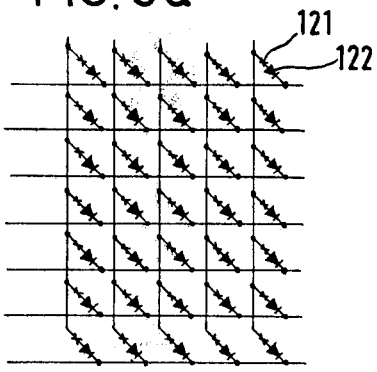
FIG. 5*a* is an enlargement of part of the diagram of FIG. 5.

FIG. 5*a* shows further details of the input connection circuit 107, which is comprised of a number of on-off contacts 121 (each shown as a cruciform mark) and diodes 122. The on-off contacts 121 are associated with various setting switches which give the above information, and for which dip switches or digital switches can be used. Those contacts 121 are formed into a dynamic key scan network in matrix, wherein an output voltage from a decoder 106 (FIG. 5) is supplied in turn at every row of the contacts, which are connected through diodes 122 and lateral lines to input port terminals of the microcomputer 101. Therefore, the input port voltages which change in response to changes in on-off situations of the contacts 121 give the information from external settings to the microcomputer. The diodes 122 prevent interferences between the contacts belonging to different rows at their output side.

The microcomputer 101 is also connected with a deposit sensor 113, which detects deposited coins and their denominations, so that the computer 101 accumulates the amount of the coins and gives it to a display 104 through a display control 105. When one of selection switches associated with the input connection circuit 107 is actuated after depositing coins adequate for the selected vend, the microcomputer 101 operates to produce necessary electronic outputs initiating the vend, so that the outputs are fed through an amplifier 102 to manipulate necessary vending mechanisms 103, to feed and process materials and so on. The mechanisms 103 include, for example, cup serving motors, several syrup supplies, cold water supply, soda water supply, ice outlet gate actuator, ice machine motor, water cooler, various control valve actuators, various auxiliary counters and various drive elements such as change making solenoids of a coin mechanism, and the like. Their operations are initiated by electronic outputs directly or through some electromagnetic relays.

The microcomputer 101 can further include means to produce signals to initiate operations to veto coin deposits when their amounts are in excess of a required value, or to give back change, as well as signals to initiate various controls for a refrigerator and valves to keep a predetermined cold water temperature, its quantity, and an ice storage quantity.

The microcomputer 101 is further connected with various indicator lamp circuits which include the no-ice signal lamp (indicating an ice shortage) together with other various indicator lamps to show no coin storages for change, and sellout due to shortages of materials such as syrups, soda water, cold water and cups, as well as lamps to indicate available commodities corresponding to the coins deposited. Means are provided for certain indicator lamps to be turned off when subsequent operations of vending mechanisms have taken place, so that, for example, when a selection switch is actuated for a commodity, a lamp corresponding to it remains on but others are turned off.

In case of a vending machine for twelve kinds of commodities or beverages which is provided with indicator lamps for availability and sellout of each of the twelve items, twenty-four individual indicator lamps are required in addition to several lamps for other purposes such as indicating the vendor being in service, lacking in coins for change, and so on. Consequently, a total of about thirty individual indicator lamps are required, together with electronic circuits connected to them. However, the number of such circuits will exceed the number of control output terminals which a usual one-chip microcomputer is provided with. Therefore, the device shown in FIG. 5 is provided with a group of shift registers SR1, SR2, etc. connected to the microcomputer 101, and means to supply clock pulses CL to the shift registers. The various control data are sent to the shift registers SR1, SR2, and so on, and the data shift in turn with every generation of the clock pulse CL. Thus, an effect equivalent to an increase in number of control output terminals of the microcomputer 101 is obtained.

Each of the circuits connected after the shift register comprises an amplifier 109, an AND-gate 110, an indicator lamp 111 and a vend counter 112. When a selection switch is actuated to vend a commodity or beverage, a corresponding one of the lamps 111 remains on while others of them are turned off as mentioned. Subsequently, when a signal is produced to inform the completion of the vend operation, a pulse CT is supplied to each AND-gate 110, resulting in the appropriate vend counter 112 counting by one, so that it registers the total number vended of the particular commodity.

Ice supply quantity setting means, as mentioned in other embodiments, as well as other various vend quantity setting means are connected with the device (though they are not shown in FIG. 5) and serve as already mentioned.

FIG. 6 shows an embodiment of mechanical means for setting the levels to turn the ice storage sensor output on and off with hysteresis as mentioned in conjunction with the first embodiment. The means comprises a hysteresis setter 233, a lever 236 and a microswitch 232, all shown together with a main portion 212 of an ice machine 211 and its ice storage chamber 213. A coolant coil 215 of the ice machine cools water fed through an inlet 216. A screw shaft 218 driven by a motor 217 scrapes out ice flakes produced on the inside of cooling cylinder 214, and carries them upward into the storage chamber 213 through a crushing ring 220, which breaks up the ice flakes into small pieces 221. A floating disk 229 is disposed above the ice pieces and moves vertically with changes in ice storage quantity. A movable rod 230 is linked with the disc 229, and at the top of the rod 230 the hysteresis setter 233 is removably mounted with a screw bolt 234.

Ice is discharged through the port 225 when the outlet gate 224 is lifted, and water is drained from the chamber 213 through the screen 227 and the drain 226. A plurality of arms 228 mounted on a shaft extending from the screw shaft 218 insures that the ice pieces are uniformly distributed in the chamber 213.

When the ice storage quantity is decreasing and drops to a predetermined level, an upper flange **233*a* of the setter 233 thrusts the lever 236 downwards, so that microswitch 232 closes, as shown in FIG. 6. A pair of magnetic members 237 is mounted to the lever 236 and a stationary part of the microswitch 232, and produces a pulling force between them, so that once the contacts of the microswitch 233 are in their make position, they are kept in the same position despite the absence of a thrusting force of the upper flange 233*a* of the setter 233. On the other hand, when the ice storage quantity is increasing, the rod 230 moves upward together with the setter 233. At another position shown in FIG. 6*a*, a lower flange 233*b* thrusts the lever 236 upward to break the contacts of the microswitch 232. The upper and lower flanges 233*a* and 233*b* are put in a vertically spaced arrangement. The hysteresis setter 233 is replaceable, so that the distance between the upper and lower flanges 233*a* and 233*b*** is adjustable by selecting a setter having the desired spacing between the flanges.

In an alternative to the above hysteresis arrangement, the setter comprises two pieces 239 and 240 as shown in FIG. **6*b*, having upper and lower flanges 239*a* and 240*a* respectively, thereby providing more convenient adjustability of the distance therebetween. Each of the pieces 239 and 240 is provided with a threaded bore 241 for receiving a bolt 234 for adjustably securing the pieces to the rod 230**.

Numerous further variations and modifications may be effected without departing from the spirit and scope of the invention. It is intended to include within the scope of the appended claims all such variations and modifications.

We claim:

1. In an automatic vendor having an ice machine with a storage chamber in which the produced ice is stored and from which the ice is supplied during vending, and which is provided with a sensor producing a signal when the ice quantity in the chamber reaches a predetermined full storage level, the improvement comprising:

means for producing digital signals representative of quantities of ice makeup to and ice discharge from the storage chamber;

counting means for receiving said digital signals and for storing a count value indicative of the quantity of ice in said storage chamber, and for producing an output signal when its count value is not less than a predetermined minimum value, and for producing an auxiliary output signal when the count value is at least a predetermined intermediate value less than the full count;

a vend control responsive to the counting means output signal, to deactivate the vending operation of the vendor in response to cessation of said counting means output signal; and means responsive to said auxiliary output signal for starting operation of said ice machine to make ice upon interruption of said auxiliary output signal.

2. In an automatic vendor having an ice machine with an ice storage chamber from which ice is supplied during vending, and which is provided with an ice level sensor which produces a sensor output signal when the ice quantity in the chamber reaches a predetermined full storage level, the improvement wherein the ice storage sensor includes means for setting the levels at which the sensor output is turned on and off with hysteresis, comprising:

a first mechanical member which moves generally upward and downward in response to the variation of ice quantity in the storage chamber;

upper and lower flanges mounted to the first mechanical member at a spaced vertical distance from each other;

a second mechanical member which is movable and which has a portion disposed between said flanges;

an electrical switch adapted to be turned on and off in response to the movement of the second mechanical member; and a pair of magnetic members mounted to the second mechanical member and to a stationary member facing said second mechanical member, which are in magnetic alignment with each other so as to produce a latching force to latch the second mechanical member in the switch on position after the electrical switch is switched on, whereby when the second mechanical member is latched in the switch on position by a downward motion of the upper flange of the first mechanical member, the second mechanical member remains latched in said switch on position until the lower flange abuts it, unlatches it, and moves it upwardly.

3. The vendor as set forth in claim 2 wherein the counting means comprises an up-down counter and an auxiliary output circuit, and wherein the vend control comprises a primary output circuit;

wherein the up-down counter is comprised of a plurality of cascaded flip-flops;

and wherein the primary output circuit is an OR-circuit comprised of a set of parallel diodes each connected with one of the cascaded flip-flops;

and wherein the auxiliary output circuit is comprised of an additional OR-circuit comprised of another set of parallel diodes each connected with one of the flip-flops which represent values not less than that intermediate count value less than the full count, and an auxiliary NOT-circuit, connected to receive the auxiliary output and responsive to the absence of an auxiliary output signal, and which produces another output signal which energizes a relay to initiate start of the ice machine.

* * * * *